US007859180B2

(12) United States Patent
Prinz et al.

(10) Patent No.: US 7,859,180 B2
(45) Date of Patent: Dec. 28, 2010

(54) ELECTRODE ARRANGEMENT

(75) Inventors: Eckhard Prinz, Hamfelde (DE); Peter Palm, Hamburg (DE); Frank Forster, Hamburg (DE)

(73) Assignee: Softal Electronic Erik Blumenfeld GmbH & Co., Hamburg (DE)

( * ) Notice: Subject to any disclaimer, the term of this patent is extended or adjusted under 35 U.S.C. 154(b) by 224 days.

(21) Appl. No.: 12/303,454

(22) PCT Filed: Jun. 1, 2007

(86) PCT No.: PCT/EP2007/004851

§ 371 (c)(1),
(2), (4) Date: Dec. 4, 2008

(87) PCT Pub. No.: WO2007/144075

PCT Pub. Date: Dec. 21, 2007

(65) Prior Publication Data

US 2009/0200911 A1 Aug. 13, 2009

(30) Foreign Application Priority Data

Jun. 13, 2006 (EP) ..... 06012197

(51) Int. Cl.
*H01T 18/00* (2006.01)
*H01J 1/88* (2006.01)

(52) U.S. Cl. ..... 313/326; 313/243; 204/280; 204/286.1; 204/297.01; 204/298.41; 118/625

(58) Field of Classification Search ..... None
See application file for complete search history.

(56) References Cited

U.S. PATENT DOCUMENTS

| | | | | |
|---|---|---|---|---|
| 3,133,193 | A * | 5/1964 | Guillotte et al. | 250/324 |
| 4,946,568 | A * | 8/1990 | Kalwar et al. | 204/164 |
| 5,180,948 | A * | 1/1993 | Heinemann et al. | 315/111.21 |
| 2003/0019580 | A1 * | 1/2003 | Strang | 156/345.33 |

FOREIGN PATENT DOCUMENTS

| | | |
|---|---|---|
| EP | 0 095 | 11/1983 |

* cited by examiner

*Primary Examiner*—Ashok Patel
(74) *Attorney, Agent, or Firm*—Sand & Sebolt

(57) ABSTRACT

Disclosure of an electrode arrangement (1) as high voltage electrode for continual plasma treatment or plasma coating of web material with several knife electrodes (3) arranged at a right angle to any transport direction of the web material and essentially located parallely to each other which is characterized by the fact that the distances (a–e) of adjacent knife electrodes (3) vary. In tests it has turned out that a more uniform coating result or, respectively, treatment result can be achieved with such an electrode arrangement than with comparable arrangements in which the knife electrodes are arranged equidistant. Preferably, the distances (a) between adjacent knife electrodes (3) are larger at the edges of the electrode arrangement (1) than the distances (e) between adjacent knife electrodes (3) in its center.

14 Claims, 2 Drawing Sheets

ELECTRODE ARRANGEMENT

Figure 1:
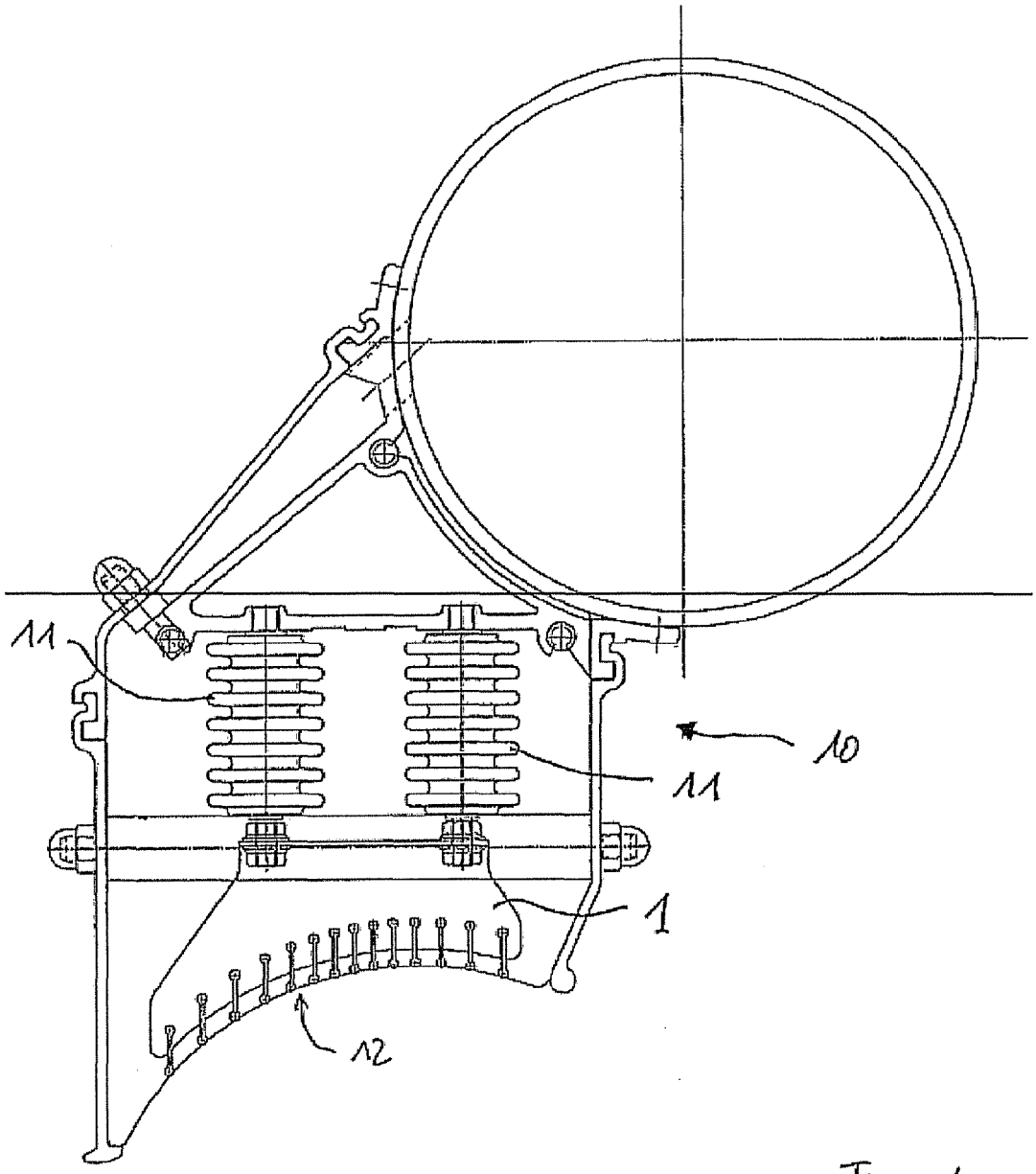

The invention relates to an electrode arrangement as high voltage electrode for continual plasma treatment or plasma coating of web material with several knife electrodes arranged at a right angle to any transport direction of the web material and essentially located parallel to each other.

Such electrode arrangements have been known and have been used in many different ways in plasma treatment or plasma coating of web material that, as a rule, is not electrically conductive, e.g. plastic foil or the like. These electrodes are typically used as high voltage electrodes, with a transport/feed cylinder designed as counterelectrode located opposite the free ends of the knife electrodes.

The plasma discharge between knife electrodes is ignited by the potential differential in the gas gap opposite the counter electrode, and the material is plasma-treated or, respectively, plasma-coated.

In this context, plasma treatment typically occurs without the use of precursors, with only a change of the surface conditions of the treated material occurring due to the ignited plasma in order to improve the adhesion of a coating material or the like applied later. In the same manner, a plasma coating can be carried out with such electrodes, with precursors being positioned here in the gap or, respectively, space formed between the electrodes and the web material that provide the starting materials for the coating.

The so-called starting materials involve elongated, blade-like electrodes that as a rule are attached to a high voltage arrangement with one of their longitudinal edges and that form the actual discharge surface with their other longitudinal edge.

In the case of the known comparable electrode arrangements, the knife electrodes are arranged between adjacent electrodes at the same distance, i.e. equidistant.

In tests carried out by the applicant it has been shown that plasma treatment results or, respectively, plasma coating results obtained by means of such electrode arrangements could be improved with regard to homogeneity. In particular, sliding discharges along the material surface in many cases represent a strong, inhomogeneous thermal stress of the material that frequently limits the use of an electrode system. Accordingly, the inventors were faced with the task of improving the known electrode arrangements in order to achieve an improved treatment result or, respectively coating result on the plasma-treated or, respectively, plasma-coated web material.

At the end of a long and extensive series of tests, the surprising result was that an improvement sought in such a way can be achieved if the distances of adjacent knife electrodes, vary in contrast with the known state of the art. The physical cause for the observed improvement has so far not been fully clarified and is still the subject of further examinations. However, it seems to be decisive for the improvement that the new arrangement of the knife electrodes combines the advantages of a large knife distance with regard to the problems of sliding discharges with the advantages of a smaller knife distance with regard to the specific electrical capacitance.

The distances of adjacent knife electrodes are preferably larger at the edge of the electrode arrangement that in its center. Edge of the electrode arrangement here means those areas that lie at the front end or, respectively, at the rear end of the electrode arrangement as seen in the transport direction of the web material.

Suitable distances turned out to be distances between 8 and 12 mm at the edge of the electrode arrangement and between 2 and 6 mm in the center of the electrode arrangement.

A further improvement of the discharge picture of the electrode arrangement or, respectively, of the plasma treatment results or, respectively, plasma coating results to be obtained by it could be achieved when, the free-standing edges of the knife electrodes were equipped with discharge strips having essentially a circular shaped or partially circular shaped cross section. It has turned out that this design of the discharge strips in the case of knife electrodes yields an improved result not only in the case of the electrode arrangement equipped with knife electrodes in accordance with the invention but also in the case of electrode arrangements with knife electrodes in an equidistant arrangement. To that extent and taken per se, the design of the discharge edges represents a separate invention. In this case, the radii of the curvatures of the discharge edges need not be the same throughout but, on the contrary, may advantageously differ within the electrode arrangement. In this way, strong sliding discharges at the edge and thus at the front or, respectively, at the rear end of the electrode arrangement 1 will be minimized.

In order to maintain the same distance between the discharge edges of the knife electrodes and the surface of the web material to be plasma-treated or, respectively, to be plasma-coated, the knife electrodes are preferably arranged such that a connecting line along the free-standing edges of the knife electrodes runs in a curve in the direction of transport, and wherein the curve is adapted to be configured in accordance with an external contour of a transport cylinder.

Finally, another subject of the invention is a device for continuous plasma treatment or plasma coating of web material. In this context it is essential that the device contain an electrode arrangement as described above.

Figure 2:
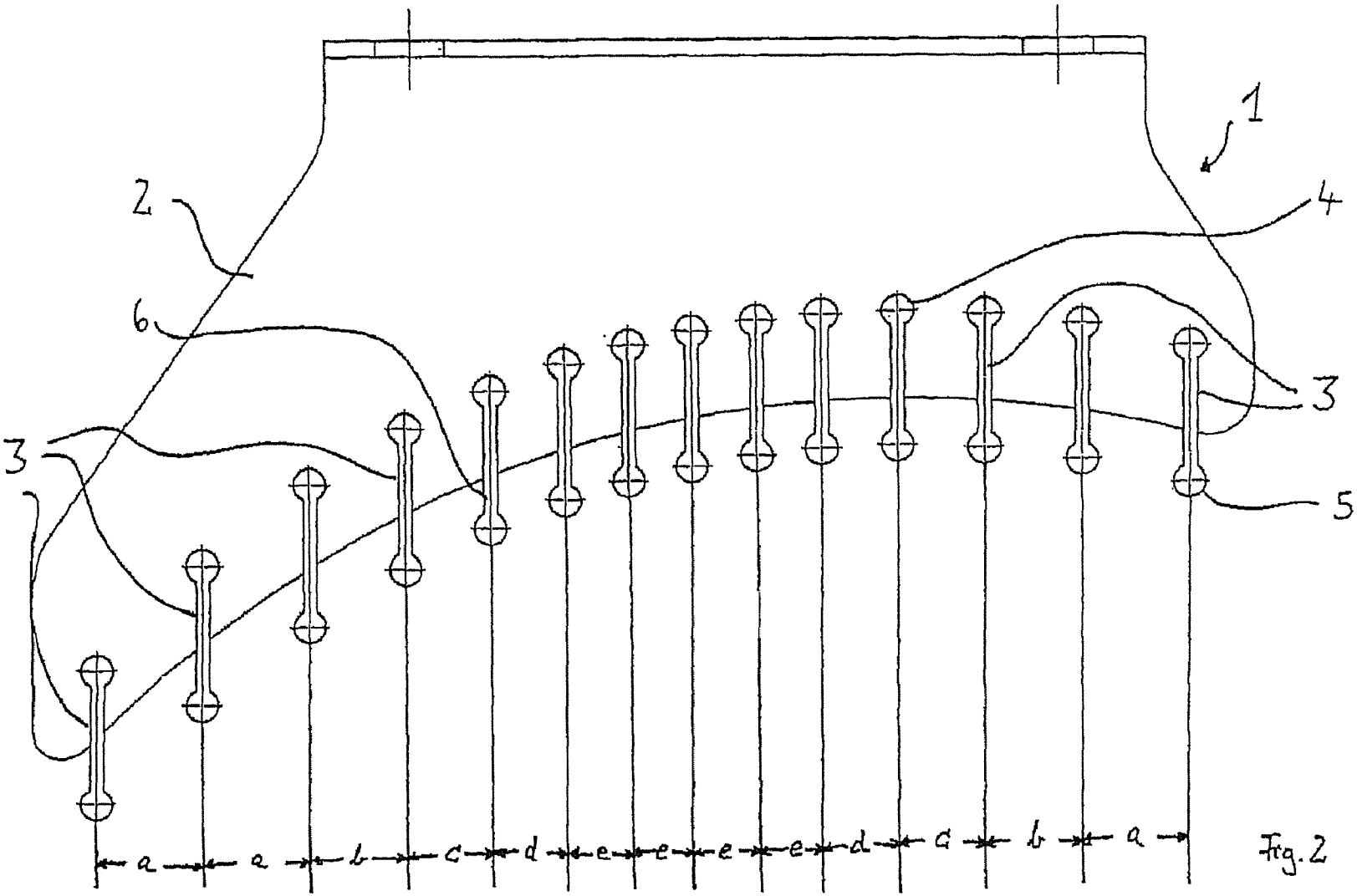

Additional advantages and characteristics of the invention result from the following description of an embodiment using the attached figures. Shown are in:

FIG. 1 a schematic view of an electrode arrangement in accordance with the invention for continuous plasma treatment or, respectively, plasma coating of web material; and FIG. 2 an enlarged representation of the electrode arrangement in accordance with the invention.

A plasma treatment device or, respectively, a plasma coating device 10 equipped with an electrode arrangement 1 in accordance with the invention is shown in FIG. 1 in sections and schematically. In this device, the electrode arrangement 1 is connected in an essentially closed space via a high voltage supply separated from the remaining device 10 by isolators 11. Opposite a treatment segment 12—here not shown in detail—lies a transport cylinder designed as a counter electrode with which the web material to be treated or, respectively, to be coated is guided through the gap between said transport cylinder and the electrode arrangement 1. The plasma—not shown in FIG. 1—is ignited between the plasma treatment device or, respectively, the plasma coating device 10 and the transport cylinder.

The electrode arrangement 1 is shown again enlarged in FIG. 2. It contains an electrode holder 2 and several knife electrodes 3, in this embodiment totaling 14. These knife electrodes are configured in bone-knife fashion in their cross section, with thickenings with an essentially circular or partially circular cross section formed on the two longitudinal edges. The first of these thickenings 4 that is formed on the edge of the knife electrode 3 arranged in the electrode holder 2 serves to hold the knife electrode 3 in the electrode holder 2. The second thickening formed on the free-standing edge of the knife electrode forms a discharge strip 5. This discharge strip 5 is made thicker or, respectively, stronger in its cross section than the blade 6 of the knife electrode 3 connected thereto.

The diameter of the discharge strip 5 does not need to be uniform in the electrode arrangement so that sliding discharges at the edge and thus at the front or, respectively, at the rear end of the electrode arrangement 1 will be minimized.

The individual adjacent knife electrodes 3 are arranged at variable distances to each other, with the distances between adjacent knife electrodes 3 at the extreme edges of the electrode arrangement being larger than the distances of adjacent knife electrodes 3 in the center of the arrangement 1.

In this example, a total of five different distances are provided and designated in the figure with the numbers a through e, with the distances from a to e each becoming smaller. In one example of an embodiment the distances a through e may be designed as follows:

a=10 mm
b=9 mm
c=8 mm
d=7 mm
e=6 mm

The configuration of the electrode arrangement 1 in accordance with the invention, with the knife electrodes 3 arranged behind each other at varying distances and extending essentially parallel to each other in the transport direction of the web material to be treated or, respectively, to be coated creates an improved homogeneity and quality of the plasma-treatment or, respectively, plasma-coating carried out by it of the web material carried through on the transport cylinder designed as a counter electrode. This could be confirmed in tests. The design of the discharge strip 5 with the circular or partially circular cross sections also resulted in an improved quality of the plasma coating or, respectively, of the plasma treatment as compared with known discharge strip shapes.

The shape of the electrode arrangement 1 shown in the embodiment and the distances a through e are not limiting; instead, several different forms and distance distributions may be adhered to. The characteristics of the invention are reflected in the claims that are to define the scope of the invention or, respectively, of the protection.

LIST OF REFERENCE SIGNS

1 Electrode arrangement
2 Electrode holder
3 Knife electrode
4 Thickening
5 Discharge strip
6 Blade
10 Plasma treatment device or, respectively, plasma coating device
11 Isolator
12 Treatment segment
a Distance
b Distance
c Distance
d Distance
e Distance

The invention claimed is:

1. An electrode arrangement as high voltage electrode for continual plasma treatment or plasma coating of a web material with several knife electrodes arranged at a right angle to any transport direction of the web material and essentially located parallel to each other, wherein adjacent knife electrodes are spaced a distance apart from each other, and wherein the distances between adjacent knife electrodes vary across the electrode arrangement.

2. The electrode arrangement in accordance with claim 1, wherein the distances between adjacent knife electrodes proximate an edge of the electrode arrangement are larger than the distances between adjacent knife electrodes proximate a center of the electrode arrangement.

3. The electrode arrangement in accordance with claim 2, wherein the greatest distances between adjacent knife electrodes at the edge of the electrode arrangement are between 8 and 12 mm and the smallest distances between adjacent knife electrodes in the center of the electrode arrangement are between 2 and 6 mm.

4. The electrode arrangement in accordance with claim 2, wherein the distances between adjacent knife electrodes proximate both edges of the electrode arrangement are larger than the distances between adjacent knife electrodes proximate the center of the electrode arrangement.

5. The electrode arrangement in accordance with claim 1, wherein each electrode includes a blade with a free-standing edge at one end thereof; and wherein the free-standing edge of at least one of the knife electrodes comprises a discharge strip with one of an essentially circular and-partially circular cross-section that is thicker than the blade connected thereto.

6. The electrode arrangement in accordance with claim 5, wherein each of the knife electrodes has a circular or partially circular discharge strip at the free-standing edge thereof, and the circular or partially circular edges of the knife electrodes have varying radii of curvature within the electrode arrangement.

7. The electrode arrangement in accordance with claim 5, wherein a connecting line along the free-standing edges of the knife electrodes runs in a curve in the direction of transport, and wherein said curve is adapted to be configured in accordance with an external contour of a transport cylinder used as a counter electrode in the electrode arrangement.

8. A device for continuous plasma treatment or plasma coating of a web material, said device comprising:

electrode arrangement having several knife electrodes arranged at a right angle to any transport direction of the web material and essentially located parallel to each other, wherein adjacent knife electrodes are spaced a distance apart from each other, and the distances between adjacent knife electrodes vary across the electrode arrangement; and a transport cylinder forming a counter electrode lying opposite the electrode arrangement.

9. The device in accordance with claim 8, wherein the distances between adjacent knife electrodes proximate an edge of the electrode arrangement are larger than the distances between adjacent knife electrodes proximate a center of the electrode arrangement.

10. The device in accordance with claim 9, wherein the distances between adjacent knife electrodes proximate both edges of the electrode arrangement are larger than the distances between adjacent knife electrodes proximate the center of the electrode arrangement.

11. The device in accordance with claim 9, wherein the greatest distances between adjacent knife electrodes at the edge of the electrode arrangement are between 8 and 12 mm and the smallest distances between adjacent knife electrodes in the center of the electrode arrangement are between 2 and 6 mm.

12. The device in accordance with claim 8, wherein each electrode includes a blade with a free-standing edge at one end thereof; and the free-standing edge of at least one of the knife electrodes comprises a discharge strip with one of an essentially circular and partially circular cross-section that is thicker than the blade connected thereto.

13. The device in accordance with claim 12, wherein each of the knife electrodes has a circular or partially circular discharge strip at the free-standing edge thereof, and the circular or partially circular edges of the knife electrodes have varying radii of curvature within the electrode arrangement.

14. The device in accordance with claim 12 wherein a connecting line along the free-standing edges of the knife electrodes runs in a curve in the direction of transport and in accordance with the external contour of the transport cylinder.

* * * * *